US005792383A

United States Patent [19]

Reyes-Gavilan et al.

[11] Patent Number: 5,792,383

[45] Date of Patent: Aug. 11, 1998

[54] REDUCTION OF ENTERFACIAL TENSION BETWEEN HYDROCARBON LUBRICANT AND IMMISCIBLE LIQUID REFRIGERANT

[75] Inventors: Jose L. Reyes-Gavilan, Jersey City, N.J.; Alan D. Eckard, Chester, N.Y.; G. Thomas Flak, Pompton Lakes; Todd R. Tritcak, Bayonne, both of N.J.; Leonard Aconsky, New York, N.Y.

[73] Assignee: Witco Corporation, New York, N.Y.

[21] Appl. No.: 301,694

[22] Filed: Sep. 7, 1994

[51] Int. Cl.[6] ..... C09K 5/04

[52] U.S. Cl. ..... 252/68; 508/485; 508/495; 508/498; 508/504; 508/505

[58] Field of Search ..... 252/68, 52 R, 252/56 S; 508/485, 495, 498, 504, 505

[56] References Cited

U.S. PATENT DOCUMENTS

| | | | |
|---|---|---|---|
| 3,733,850 | 5/1973 | Olund | 62/468 |
| 4,175,047 | 11/1979 | Schick et al. | 508/485 |
| 4,900,463 | 2/1990 | Thomas et al. | 252/68 |
| 4,941,986 | 7/1990 | Jolly | 252/68 |
| 5,096,606 | 3/1992 | Hagihara et al. | 252/68 |
| 5,114,605 | 5/1992 | Mizui et al. | 252/68 |
| 5,156,768 | 10/1992 | Thomas et al. | 252/68 |
| 5,445,753 | 8/1995 | Fukuda et al. | 252/68 |
| 5,464,550 | 11/1995 | Sasaki et al. | 252/68 |

FOREIGN PATENT DOCUMENTS

| | | |
|---|---|---|
| 496937 | 8/1992 | European Pat. Off. . |
| 556662 | 8/1993 | European Pat. Off. . |
| 1115998 | 5/1989 | Japan . |
| 18491 | 1/1992 | Japan . |
| 125374 | 5/1993 | Japan . |
| 9012849 | 11/1990 | WIPO . |

OTHER PUBLICATIONS

Sanvordenker Ashrae Pub. ISBN 0910110581, pp. 211–216 (1989) Materials Compatibility of R134a in refrigerant Systems (Month Unknown).

Reyes–Gavilan Ashrae Transaction, pp. 349–360 (1993) — Performance Evaluation of Naphthenic and Synthetic Oils in Reciprocating Compressors Employing R–134a as the Refrigerant (Month Unknown).

*Primary Examiner*—Alan Diamond

*Attorney, Agent, or Firm*—Lockwood, Alex, Fitzgibbon & Cummings

[57] ABSTRACT

Fluid refrigeration compositions comprising a hydrocarbon lubricant, an immiscible refrigerant and an additive capable of reducing the interfacial tension between the hydrocarbon lubricant and refrigerant.

16 Claims, No Drawings

REDUCTION OF ENTERFACIAL TENSION BETWEEN HYDROCARBON LUBRICANT AND IMMISCIBLE LIQUID REFRIGERANT

This invention relates to fluid refrigeration compositions comprising a hydrocarbon lubricant, such as mineral oil, a refrigerant immiscible with the hydrocarbon lubricant, and additive capable of reducing the interfacial tension between the hydrocarbon lubricant and the immiscible refrigerant. More particularly this invention comprises a fluid refrigeration composition comprising a hydrocarbon lubricant, such as mineral oil, a fluorohydrocarbon refrigerant immiscible with the hydrocarbon lubricant and a surfactant capable of reducing the interfacial tension between the hydrocarbon lubricant and fluorohydrocarbon refrigerant.

For approximately the past 60 years, chlorofluorocarbons (CFC's) have been commercially used as heat exchange fluids in systems designed for refrigeration and air conditioning applications. These types of compounds have also been employed as propellants, foam blowing agents, and cleaning solvents for the electronics and aerospace industries. CFC-12 (dichlorodifluoromethane), CFC-115 (1-chloro-1,1,2,2, 2-pentafluoro-ethane), and CFC-113 (1,1, 2-trichloro-1,2, 2-trifluoro-ethane) are examples of such compounds.

Rowland and Molina hypothesized in the early 1970's that the high stability inherent in CFCs provided these molecules with a very long life in the lower atmosphere. Consequently, they slowly travel to the stratosphere, where chlorine radicals are removed from the CFC molecules by the effect of ultraviolet radiation from the sun. The radicals then attack the ozone found in this atmospheric layer decreasing its concentration. This prompted the aerosol industry in the mid-1970s to gradually replace these chemicals with environmentally safer alternates that met their product specifications.

In the mid-1980's, the detection of a drop in ozone concentration over Antarctica, an effect that is presently spreading to other areas of the globe, has prompted many nations to restrict and eventually ban the production and use of CFCs before the end of the century. Consequently, several compounds have been suggested for use as alternate refrigerants. These compounds belong to the hydrochlorofluorocarbon (HCFC) and hydrofluorocarbon (HFC) chemical families. Examples of HCFCs are R-22 (hydrochlorodifluoromethane), R-123 (1,1-dichloro-2,2, 2-trifluoro-ethane), and R-124 (1-chloro-1,2,2, 2-tetrafluoro-ethane). HCFCs have much lower ozone depletion potentials than do CFCs because even though there is chlorine present in these molecules, they contain hydrogen atoms that cause their decomposition to take place at lower levels of the atmosphere. However, since the depletion of the ozone layer is currently continuing and expanding to other areas of the globe, there is much legislative pressure to eventually restrict and ban these chemicals as well. Hence, these are perceived as short-term refrigerant alternates. Presently used naphthenic mineral oil, alkylbenzenes, and naphthenic mineral oil/alkylbenzene blends have traditionally met the lubricating and performance needs of refrigeration systems charged with HCFCs.

Examples of HFCs are R-134a (1,1,1, 2-tetrafluoroethane), R-152a (1,1-difluoroethane), R-32 (difluoromethane), R-143a (1,1,1-trifluorethane), R-125 (1,1,1,2,2-pentafluoroethane), and azeotropic and zeotropic blends consisting of any one of these, or other, HFC components. These molecules are not ozone depleters and hence, have presently been adopted as long term alternate refrigerants. While HFC refrigerants may have desirable physical properties that make them appropriate long term refrigerant alternates, they lack miscibility with naphthenic mineral oils traditionally used as refrigeration compressor lubricants. The mineral oils' chemical stability and miscibility with CFC and HCFC refrigerants, chemical compatibility with all system components, low floc and pour points, high dielectric strength, and proper viscosity provide the properties that enhance their overall performance once charged into the system.

The use of naphthenic refrigeration oils in refrigeration or air conditioning applications where HFCs are employed as refrigerants has been considered by some to be inappropriate due to the immiscibility of both fluids. The belief is that, immiscibility or poor dispersability between the refrigerant and lubricant at unit operating temperatures may provide unsuitable oil return to the compressor. This causes improper heat transfer due to oil coating of the inner surface of the heat exchange coils, and in extreme cases, lubricant starvation of the compressor. The former causes energy efficiency losses, and the latter results in unit burn-out.

Jolly, et al., U.S. Pat. No. 4,941,986 states that the mixture of the refrigerant and lubricant must be miscible/soluble and chemically and thermally stable over a wide temperature range, covering the operating temperature range of refrigeration and air conditioning systems. It is generally desirable for the lubricants to be miscible/soluble in the refrigerant at concentrations of about 5 to 15% over a temperature range of −40° C. to 80° C. This temperature range brackets the operating temperature of many refrigeration and air conditioning system designs in the market today.

The patentees then disclose replacing the hydrocarbon lubricating oil with various synthetic materials that are much more expensive than the hydrocarbon oils. Obviously, it is economically and environmentally desirable to provide hydrocarbon oil/alternate refrigerant fluids, even though immiscible, for use in these systems.

In American Society of Heating, Refrigerating and Air Conditioning Engineers, Sanvordenker (1989) and Reyes-Gavilan (1993) have independently pointed out that proper oil return is present in household refrigeration systems charged with HFC-134a and straight hydrocarbon oils. Sanvordenker has further explained that this condition is dependent on unit configuration; top-mount units with a horizontal evaporator work well, while side-by-side units with a vertical evaporator function, but not as well. Reyes-Gavilan has shown that by using low viscosity naphthenic mineral oil (70 SUS at 37.8° C.) in the same type of units as those tested by Sanvordenker, the dependence of oil return on unit configuration is eradicated. The agents responsible for oil return in household refrigeration systems, aside from low viscosity mineral oils with good flow characteristics in the system and proper lubrication performance in the compressors, are high refrigerant velocities and short return lines between the evaporator and compressor. It is conceivable that those refrigeration or air conditioning systems with either low refrigerant velocities and/or long return lines between the evaporator and the compressor can experience poor oil return, resulting in any of the aforementioned system performance problems.

Prior art teaching the use of hydrocarbon oils in refrigeration or air conditioning systems employing HFC refrigerants is limited. U.S. Pat. No. 5,096,606 to Kao Corporation, discloses and claims compositions comprising HFCs and polyolesters, which can be blended with other lubricants.

U.S. Pat. No. 5,114,605 to Mitsui Petrochemical discloses a composition comprising a hydrofluorocarbon, polyether carbonate and either a mineral oil or alpha olefin oligomer.

Abstract of Japanese Patent No. 4,018,491 discloses that blends of an ester oil and a hydrocarbon oil such as mineral oil are compatible with hydrofluorocarbon refrigerants wherein the ratio of ester oil to hydrocarbon oil is at least unity.

Abstract of Japanese Patent No. 1,115,998 discloses blends of an alkylbenzene, a mineral oil and a hydrofluorocarbon refrigerant.

Lubrizol PCT WO/12849 suggests using viscosity adjusters such as naphthenic mineral oils. However, no mention is made of improvement in dispersability or miscibility/solubility characteristics of the hydrocarbon lubricant in the presence of HFC refrigerants.

These references teach those skilled in the art the possibility of using blends comprising hydrocarbon lubricants in HFC refrigeration and air conditioning applications. The industry has noted however; that many hydrocarbon lubricant CFC systems retrofitted to employ HFC/polyol ester fluids have shown performance degradations, indicative of poor oil return to the compressor, when the residual mineral oil content in the polyol ester exceeds 1% of the total lubricant in the system. No mention is made in these applications, nor in the references quoted above, concerning the issue of the synthetic lubricant's inherent polarity. The higher the polarity (i.e., the more miscible the lubricant is in the HFC or HCFC refrigerant), the better will its ability be to return mineral oil to the compressor from the system heat exchangers and lines.

For purposes of this invention, the term "immiscible" means that a two-phase system is formed between refrigerant and lubricant, at least at any point in the typical operating range of −40° C. to 80° C. in the refrigeration or air conditioning systems.

The general object of this invention is to provide refrigeration fluid compositions comprising a hydrocarbon lubricant, preferably a mineral oil lubricant, and a refrigerant immiscible with the hydrocarbon lubricant containing at least one carbon and one fluorine atom. A more specific object of this invention is to provide refrigeration fluid compositions comprising a mineral oil lubricant and a hydrofluorocarbon refrigerant immiscible with mineral oil. Other objects appear hereinafter.

We have now found that the objects of this invention can be obtained with refrigeration fluid compositions comprising a hydrocarbon lubricant, a refrigerant immiscible with the hydrocarbon lubricant containing at least one carbon atom and one fluorine atom, and an effective amount of an additive capable of reducing the interfacial tension between the hydrocarbon lubricant and the immiscible refrigerant.

The composition of this invention can be used in refrigeration and air conditioning systems with potential oil return difficulties, when charged with straight hydrocarbon oil and HFC refrigerants. The aim is to facilitate oil return to the compressor by making the refrigerant and hydrocarbon lubricant more dispersible with each other, allowing the refrigerant to wash the lubricant off the inner surfaces of the heat exchangers. The invention provides proper lubrication and energy efficiency to the unit, while maintaining adequate chemical and thermal stability within the system.

Briefly, the refrigeration fluid compositions of this invention comprise a hydrocarbon lubricating oil, a refrigerant containing at least one carbon and one fluorine atom and an additive capable of reducing the interfacial tension between the hydrocarbon lubricant and the refrigerant.

Suitable hydrocarbon lubricants useful in this invention include paraffinic mineral oils, naphthenic mineral oils, alkylbenzene oils, polyalphaolefins and their oligomers, and mixtures thereof. Minor amounts (1 to 20% by wt.) alkylbenzene with major amounts (99 to 80% by wt.) naphthenic mineral oil are particularly useful for improving the solubility or dispersability of some additives (i.e. surfactants such as 2,4,7,9-tetramethyl-5-decyne-4,7-diol) in the hydrocarbon oil.

Suitable refrigerants useful in this invention include those which contain at least one carbon atom and one fluorine atom. Examples of suitable refrigerants include R-22 (chlorodifluoromethane), R-124 (1 -chloro-1,2,2,2-tetrafluoroethane), R-134a (1,1,1, 2-tetrafluoroethane), R-143a (1,1,1-trifluoroethane), R-152a(1,1-difluoroethane), R-32 (difluoromethane), R-125 (1,1,1,2,2-pentafluoroethane), and mixtures thereof such as R-404a [R-125 (44 wt. %), R-143a (52 wt. %), R-134a (4.0 wt. %)]. These mixtures can also contain propane as component of the blend in those applications where the heat exchange fluid is going to be used as an interim retrofit fluid for existing refrigeration and air conditioning equipment. If desired, the suitable refrigerants can be used with CFC refrigerants, particularly, where residual amounts of these refrigerants are present in a system being retrofitted.

The additives useful in this invention for reducing the interfacial tension between lubricant and refrigerant have the property of facilitating the displacement of oil from metal surfaces by the refrigerant. This property can be determined by sealing a refrigerant immiscible at room temperature, such as R134a, with the hydrocarbon lubricant, the hydrocarbon lubricant and additive agents in a glass tube containing a steel or iron chip. A two phase system forms with the lubricating oil constituting the top layer and the refrigerant the bottom layer. The metal chip is then raised up to the oil level in the tube using a magnet and the oil is allowed to completely wet the metal surface by moving the metal chip rapidly up and down in the oil. The additive is suitable for use in this invention, if the refrigerant displaces the oil when the chip is slowly lowered into the liquid refrigerant layer.

Suitable additives include surfactants, such as 2,4,7,9-tetramethyl-5-decyne-4,7-diol sold as Surfynol SE, fluorocarbon esters sold as FC-430, etc. In some cases, it can be desirable to enhance the solubility of surfactants in the hydrocarbon lubricants with cosolvents or by using hydrocarbon lubricants made up of two or more components. For example, as indicated above, minor amounts of alkylbenzene hydrocarbons improve the solubility or dispersability of some additives in mineral oil.

While applicants do not wish to be bound by any theory, applicants believe that the interfacial tension at the refrigerant (liquid)/1GS interface is reduced to the point where the spreading coefficient (S) refrigerant liquid on steel is slightly positive or very close to zero which enables the refrigerant to displace the oil with slight agitation or due to the difference in specific gravity.

The concept of spreading coefficient is defined by: Y=gamma.

$$S=Y_{23}-Y_{12}-Y_{13}$$

Where S is the spreading coefficient of fluid (1) against fluid (2) on the surface of a third (3) phase, a solid. The "Y" terms are the respective interfacial tensions. Spontaneous spreading will occur if S>O. Other influences such as differences in specific gravity or mechanical shear energy also apply, but S will denote the contribution of interfacial tensions as influenced by additives or surface active agents.

1=refrigerant

2 =1GS

3=Steel Surface in the case where no additive is present $$O>Y_{23}-Y_{12}-Y_{13}$$

and $Y_{12}$ is a significant positive number as is apparent from the prominent meniscus between the two phases. Also, since the oil preferentially wets and continues to wet the steel even with some degree of agitation;

$$Y_{13}>Y_{23}$$

This leads to the conclusion that $Y_{12}+Y_{13}>Y_{23}$

Upon the addition of certain surfactants, a different behavior results which is described by:

$$0\leqq Y_{23}-Y_{12}-Y_{13}$$

by observation:

$Y_{12}\rightarrow 0$ (flat meniscus)

$Y_{23}\geqq Y_{13}$ (refrigerant displaces oil on steel surface)

This leads to the conclusion that the spreading coefficient for refrigerant on steel approaches 0 or becomes slightly positive, in the presence of certain additives which reduce $Y_{12}+Y_{13}$ faster than $Y_{23}$.

The additive or surface active agent can be used in the range of 0.001 to 5 parts by weight per 100 parts by weight lubricating oil. Concentrates can be prepared containing up to 100 parts by weight surface active agent per 100 parts by weight solubility improver for purposes of adding same to refrigerating systems containing hydrocarbon lubricating oils containing no surface active agent or insufficient amounts for the desired purpose.

The weight ratio of lubricating oil to immiscible refrigerant can range from 0.10 to 15 parts by weight per 100 parts by weight refrigerant as is conventional in this art.

Table I presents suitable stability and wear enhancing additives that may be used with hydrocarbon lubricants employing surface active agents in refrigerant and air conditioning applications with lubricant immiscible refrigerants.

TABLE I

Example of Suitable Additives (Stabilizing and Antiwear)

| Trade Name | Additive Chemical and Functional Characterization | Wt. % |
|---|---|---|
| BHT | Phenolic antioxidant | 0.5 |
| Irganox L-57 | Amine antioxidant | 0.5 |
| Reomet 39 | Triazole derivative copper corrosion inhibitor | 0.5 |
| ERL 4221 | Epoxide | 0.5 |
| Syn-O-Ad 8478 | Triaryl phosphate ester antiwear agent | 5.0 |
| Durad 620B | Phosphate ester antiwear agent | 5.0 |
| Additive RC8210 | Sulfurized extreme pressure agent | 2.5 |

EXAMPLE I

A 9 mL glass tube was charged with 0.050 mL of 70 SUS naphthenic mineral oil (Suniso 1GS) containing 0.5% by weight candidate surfactant, a 6 mm steel chip and 0.70ml 1,1,1,2-tetrafluoroethane (R-134a) and sealed. A two phase system was formed with the naphthenic mineral oil constituting the top layer and the hydrofluorocarbon the bottom layer. The metal chip was completely wetted with oil by moving the chip rapidly up and down in the oil phase using a magnet. The chip was then slowly lowered into the tetrafluoroethane layer. The results are set forth below in Table II.

TABLE II

| Surface Active Agent | Blend Behavior |
|---|---|
| Diisoamyl (PIB) Succinate | Oil clings to chip. Oil clings to glass. |
| EXP 5159-197 (Fluorinated ester made by Organics) | Improvement in dispersability but oil clings to chip and glass. |
| Tetrakis (2-ethylhexanol) Pentaerythritol | Oil clings to chip and glass. |
| Surfynol SE | Oil removed from chip and glass by refrigerant. Two layers very dispersible. |
| Surfynol TG | Oil clings to chip and glass. |
| EX 1038 (Carboxylic acid dimer ester) | Oil clings to chip and glass. |
| FC-430 | Oil removed from chip and glass by R-134a. Two layers very dispersible. |
| FC-431 | Oil clings to chip and glass. |
| FC-740 | Oil clings to chip and glass. Excessive frothing. |

The above data clearly shows Surfynol SE comprising 2,4,7,9-tetramethyl-5-decyne-4,7-diol and FC- 430 comprising a fluorinated ester are suitable for use in this invention.

EXAMPLE II

A 9 ml glass tube was charged with 0.050 ml of 70 SUS naphthenic mineral oil (Suniso 1GS) containing 0.05% by weight candidate surfactant (Surfynol SE or FC- 430), a 6 mm steel chip and 0.70 ml 1,1,1,2 tetrafluoroethane (R-134a) and sealed. A two phase system was formed with the naphthenic mineral oil constituting the top layer and the hydrofluorocarbon the bottom layer. The metal chip was completely wet with oil by moving the chip rapidly up and down in the oil phase using a magnet. The chip was then slowly lowered into the tetrafluoroethane layer. For both candidates, the oil is removed from the chip and glass by the R-134a. Both lubricant and refrigerant layers are very dispersible with each other, causing the oil to be removed from the surface of the chip and glass by R-134a.

EXAMPLE III

A multizone pump down solenoid medium temperature supermarket freezer rack in New England, equipped with two five door freezer rack cabinets (each 105.6 $ft^3$), a compressor (Copelametic Model No. R-76 WMT3T) located approximately 6 to 7 ft. off the ground, and evaporators on the floor of each cabinet was retrofitted. The refrigerant gas and oil travel through approximately 20 ft. of ⅞ inch diameter vertical and horizontal suction return lines before arriving at the compressor through a 1⅜ inch tube. The system was charged with R-402A (30 pound charge), which comprised 38 wt. % R125 (pentafluoroethane), 60 wt. % R22 (hydrochlorodifluoromethane), and 2 wt. % R290 (propane) and a 200 SUS alkylbenzene lubricating oil containing antiwear and foaming agents. As the unit operated below −5° F., the lubricant level in the compressor went down and the oil pressure switch turned off the unit. The system was then operated at about 0° F. to maintain proper oil pressure and lubrication.

The oil was drained from the system leaving some residual alkylbenzene; charged with 150 SUS oil comprising primarily naphthenic mineral oil, 10 wt. % alkylbenzene, and 0.05 wt. % Surfynol SE; evacuated for ½ hour and allowed to run for 1 hour to flush residual alkylbenzene oil from the system. During this time, the oil pressure switch did not go off and −17° F. and −10° F. temperature were attained for the respective racks. After 1 hour, the oil was drained again from the system and replaced with fresh 150 SUS oil comprising primarily naphthenic mineral oil, 10 wt. % alkylbenzene, and 0.05 wt. % Surfynol SE. Both freezers have been operated for two months at −10° F. to −15° F. with no oil return difficulties.

We claim:

1. A fluid refrigeration composition comprising a hydrocarbon lubricant, a fluorohydrocarbon refrigerant immiscible with the hydrocarbon lubricant which contains at least one carbon atom and all the halogen groups of the fluorohydrocarbon are fluorine, and an effective amount of additive which reduces the interfacial tension at the interface between the hydrocarbon lubricant and the refrigerant in liquid form to the point where the spreading coefficient(s) refrigerant liquid on steel is slightly positive enabling the refrigerant to displace hydrocarbon lubricant from steel wherein said additive is present in a concentration of 0.001 to 5 parts by weight per 100 parts by weight hydrocarbon lubricant.

2. The composition of claim 1, wherein the hydrocarbon lubricant comprises a paraffinic mineral oil.

3. The composition of claim 1, wherein the hydrocarbon lubricant comprises a naphthenic oil.

4. The composition of claim 1, wherein the hydrocarbon lubricant comprises an alkylbenzene oil.

5. The composition of claim 1, wherein the hydrocarbon lubricant comprises a polyalfaolefin.

6. The composition of claim 1, wherein the hydrocarbon lubricant comprises a major amount of naphthenic mineral oil and a minor amount of an alkylbenzene oil.

7. The composition of claim 1, wherein the fluorohydrocarbon comprises 1,1,1, 2-tetrafluoroethane.

8. The composition of claim 1, wherein the fluorohydrocarbon comprises pentafluoroethane.

9. The composition of claim 1, wherein said composition also comprises difluoromonochloromethane.

10. The composition of claim 1, wherein the additive comprises a surfactant.

11. The composition of claim 10, wherein the surfactant comprises 2,4,7,9-tetramethyl-5-decyne-4,7-diol.

12. The composition of claim 10, wherein the surfactant comprises a fluoroester.

13. The composition of claim 1, wherein the refrigerant is immiscible over the whole temperature range of −40° C. to 80° C.

14. A fluid refrigeration composition comprising a hydrocarbon lubricant comprising at least one member selected from the group consisting of paraffinic mineral oil, naphthenic mineral oil, alkylbenzene oil, and polyalfaolefin, a refrigerant immiscible with the hydrocarbon lubricant containing at least one carbon atom and one fluorine atom, and an effective amount of a surface active agent comprising at least one member selected from the group consisting of 2,4,7,9-tetramethyl-5-decyne-4, 7-diol and fluoroester which reduces the interfacial tension between the hydrocarbon lubricant and the refrigerant in liquid form such that the refrigerant can displace the lubricant from the inner surfaces of heat exchangers and lines.

15. The composition of claim 14, wherein the refrigerant comprises a fluorohydrocarbon wherein all the halogen groups of the fluorohydrocarbon are fluorine.

16. The composition of claim 15, wherein the surface active agent comprises 2,4,7,9-tetramethyl-5-decyne-4,7-diol.

* * * * *

UNITED STATES PATENT AND TRADEMARK OFFICE

CERTIFICATE OF CORRECTION

PATENT NO. : 5,792,383

DATED : August 11, 1998

INVENTOR(S) : Jose L. Reyes-Gavilan, Alan D. Eckard, G. Thomas Flak, Todd R. Tritcak and Leonard Aconsky It is certified that error appears in the above-identified patent and that said Letters Patent is hereby corrected as shown below:

On the Cover Page, in the title, line 1, delete "ENTERFACIAL" and insert --INTERFACIAL--; under References Cited, Foreign Patent Documents, Japanese Patent "18491 1/1992" should read --418491 1/1992--.

Col. 1, line 1, delete "ENTERFACIAL" and insert --INTERFACIAL--.

Col. 4, line 67, "in the case where..." should start a new paragraph.

Signed and Sealed this

Twenty-fifth Day of May, 1999

*Attest:*

Q. TODD DICKINSON

*Attesting Officer*

*Acting Commissioner of Patents and Trademarks*